United States Patent [19]

Albanese

[11] Patent Number: 4,715,279

[45] Date of Patent: Dec. 29, 1987

[54] SUPPLEMENTARY LIQUID DISPENSING DEVICE

[76] Inventor: Rocco J. Albanese, 2296 Westside Dr., Rochester, N.Y. 14624

[21] Appl. No.: 12,052

[22] Filed: Feb. 6, 1987

[51] Int. Cl.[4] ..... B41L 25/12

[52] U.S. Cl. ..... 101/148; 101/141; 604/250; 604/257

[58] Field of Search ..... 101/148, 141; 604/250, 604/251, 257

[56] References Cited

U.S. PATENT DOCUMENTS

| | | | |
|---|---|---|---|
| 37,727 | 2/1863 | Reynolds | 101/148 |
| 626,270 | 6/1899 | Chambon | 101/148 |
| 847,578 | 3/1907 | Hudson | 101/148 |
| 2,637,336 | 5/1953 | Emery | 101/148 |
| 3,557,817 | 1/1971 | Royse | 101/148 |
| 3,921,630 | 11/1975 | McPhee | 604/257 |
| 3,986,452 | 10/1976 | Dahlgren | 101/148 |
| 4,137,940 | 2/1979 | Faisandier | 604/250 |
| 4,144,673 | 3/1979 | Quast | 604/179 |
| 4,652,262 | 3/1987 | Veracchi | 604/250 |

FOREIGN PATENT DOCUMENTS

| | | | |
|---|---|---|---|
| 1125134 | 6/1982 | Canada | 604/250 |
| 3411163 | 9/1985 | Fed. Rep. of Germany | 101/148 |
| 63198 | 4/1985 | Japan | 101/148 |
| 2082972 | 3/1982 | United Kingdom | 101/148 |

*Primary Examiner*—Clyde I. Coughenour

*Attorney, Agent, or Firm*—Samuel R. Genca

[57] ABSTRACT

A Supplementary Liquid Dispensing Device is disclosed. The Supplementary Liquid Dispensing Device is particularly useful in lithographic printing presses and in particular for dampening systems within such presses. The device dispenses from an enclosed source of a given liquid a continuous flow of the given liquid which is part of a fountain solution of the dampening system by metering the continuous flow of liquid proportionate to the rate of evaporization of the liquid in a fountain solution with very minimal evaporization loss of the liquid by the device. The device reduces air polution particularly when a volitile liquid such as alcohol is a part of the fountain solution. The device also has the advantage of supplementing and replacing alcohol in a fountain solution in a very inexpensive way without the use of a highly sophisticated and complex electronic system.

9 Claims, 6 Drawing Figures

SUPPLEMENTARY LIQUID DISPENSING DEVICE

BACKGROUND OF THE INVENTION

1. Field of the Invention

The present invention relates to a lithographic printing press and more particularly to a supplementary liquid dispensing device for a dampening or moistening system in a lithographic printing press. While the present invention may be utilized in other dampening and moistening systems, the supplementary liquid dispensing device of the present invention is particularly useful in a dampening or moistening system utilizing alcohol as a wetting agent.

2. Prior Art

Dampening or moistening systems for lithographic presses are well known to those skilled in the art. Basically, in such systems, liquid distributing rollers are rotated by friction or by mechanical drives to transfer a dampening agent or fountain solution from an open tray containing the fountain solution to a plate cylinder of the lithographic printing press. A fountain roller revolves in the fountain solution and transfers the fountain liquid to a ductor roller. Some known dampening systems to which the present invention may be used are the Molleton Dampener and the Aquamatic System of an A. B. Dick offset press manufactured by the A. B. Dick Co. It should be understood, of course, that the supplementary liquid dispensing device of the present invention may be utilized in other dampening or moistening systems. In such systems, one of the problems is that the open tray permits evaporization of the alcohol wetting agent in the fountain solution to the atmosphere or ambient air. In the past sophisticated, complex and expensive electronic systems were utilized to maintain the alcohol contents in the fountain solution at a certain level or a given specific gravity. Such systems generally were responsive to the specific gravity of the fountain solution and attempts were made to maintain the proper specific gravity of the fountain solution by adding alcohol to the fountain solution as the specific gravity of the fountain solution changed. Such systems are disclosed in U.S. Pat. No. 3,485,257 to H. W. Gegenheimer et al, entitled "Fountain Solution System and Apparatus Therefor"; U.S. Pat. No. 3,557,817 to Edwin H. Royse, entitled "Control for Mixing Fluids of Different Specific Gravity"; and U.S. Pat. No. 3,947,356 to Alfons Werhli, entitled "Arrangement for Regulating the Moistening Solution Mixture in a Moistening Solution Preparation Plant for an Offset Printing Press". Other attempts were to manually pour alcohol into the fountain solution, which of course, was left to the discretion of the press operator, and generally the pouring of the alcohol into the fountain solution by the operator was not in uniform intervals of time or quantity. Accordingly, some of the accompanying problems resulted in that the specific gravity and pH(Hydrogen ion concentration) of the fountain solution changed radically before and after pouring alcohol. Thus, the alcohol wetting agent variation resulted in polluting the non-image forming areas and emulsification of the ink due to the variation of the specific gravity and pH of the fountain solution.

This problem is especially significant when the pressroom temperature is particularly high since alcohol will evaporate from the fountain solution at a relatively high rate, thus creating the problem of maintaining the lithographic printing at a high level of quality.

Accordingly, there is a pressing need for a relatively simple, inexpensive, efficient supplementary liquid dispensing device for a dampening system of a lithographic printing press to maintain the alcohol content, the specific gravity and pH of the fountain solution of the dampening system at a reasonably constant level to insure quality printing. It is also necessary that any device for adding alcohol in and ofitself does not contribute to air polution by direct evaporization of the alcohol to the atmosphere. These problems are multiplied in a multicolor, lithographic printing system where multiple dampening systems are employed.

SUMMARY OF THE INVENTION

It is therefore a general object of the present invention to provide a supplementary liquid dispensing device for a dampening system of a lithographic printing press to overcome the aforesaid problem and disadvantage of prior art dampening systems.

More particularly, it is an object of the present invention to provide an improved dampening system by incorporating the supplementary liquid dispensing device of the present invention.

It is still a further object of the present invention to provide a supplementary liquid dispensing device for a dampening system of a lithographic printing press, which device more uniformly controls the alcohol content in a fountain solution than prior art devices, thereby improving quality, paper waste and reducing printing cost. These and other objects of the present invention are attained by a supplementary liquid dispensing device for a dampening system of a lithographic press, which device includes a frame, an inverted bottle containing alcohol for gravity feed of the alcohol, a piping means connected to the inverted bottle for gravity flowing of the alcohol to an open tray containing the fountain solution and valving means for controlling the flow of the alcohol to a rate substantially equal to the rate of loss of the alcohol in the fountain solution.

BRIEF DESCRIPTION OF THE DRAWINGS

The invention will be described in detail hereinafter with reference to the accompanying drawing which shows a supplementary liquid dispensing device in accordance with a preferred embodiment of the invention and other modifications thereto in which.

DESCRIPTION OF THE PREFERRED EMBODIMENT

Figure 1:
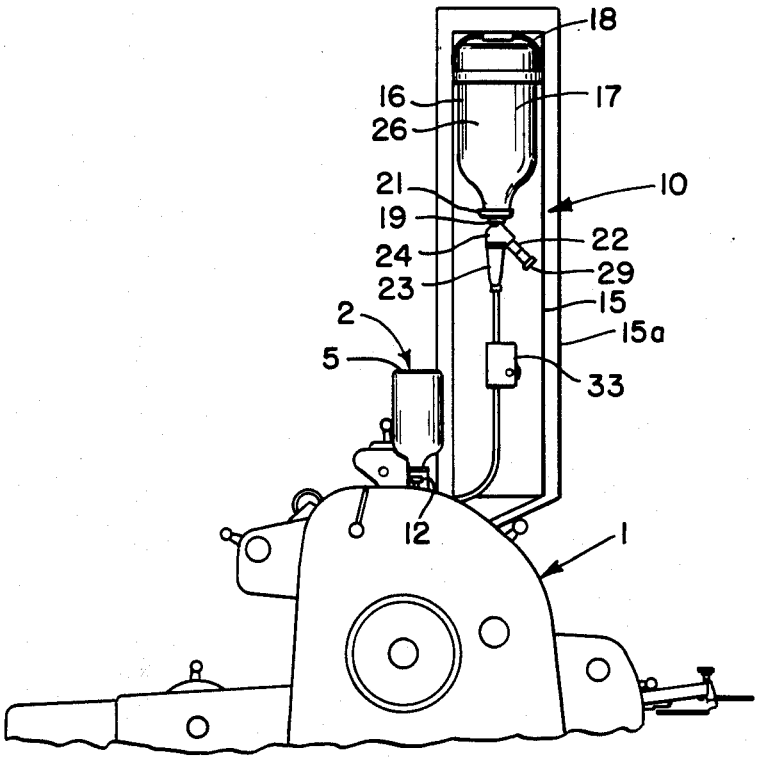
FIG. 1 is a fragmentary side elevation of a supplementary liquid dispensing device coacting with a lithographic printing press according to a preferred embodiment of the invention.

The supplementary liquid dispensing device 10 of the present invention will be described with particular reference to the preferred embodiment of the invention illustrated in the drawing. It should be understood that the drawing illustrations and description are to be taken only as illustrative of the preferred embodiment of the invention in the supplementary liquid dispensing device 10 and are to be understood in a general way and not in a restrictive way. Also, while the preferred embodiment of the invention is illustrated as being used with a lithographic offset printing press 1 of the type manufactured by A. B. Dick Co., it should be understood that the present invention may be used in other lithographic dampening systems such as those manufactured by Dahlgren Manufacturing Company of Dallas, Tex., and others.

Figure 2:
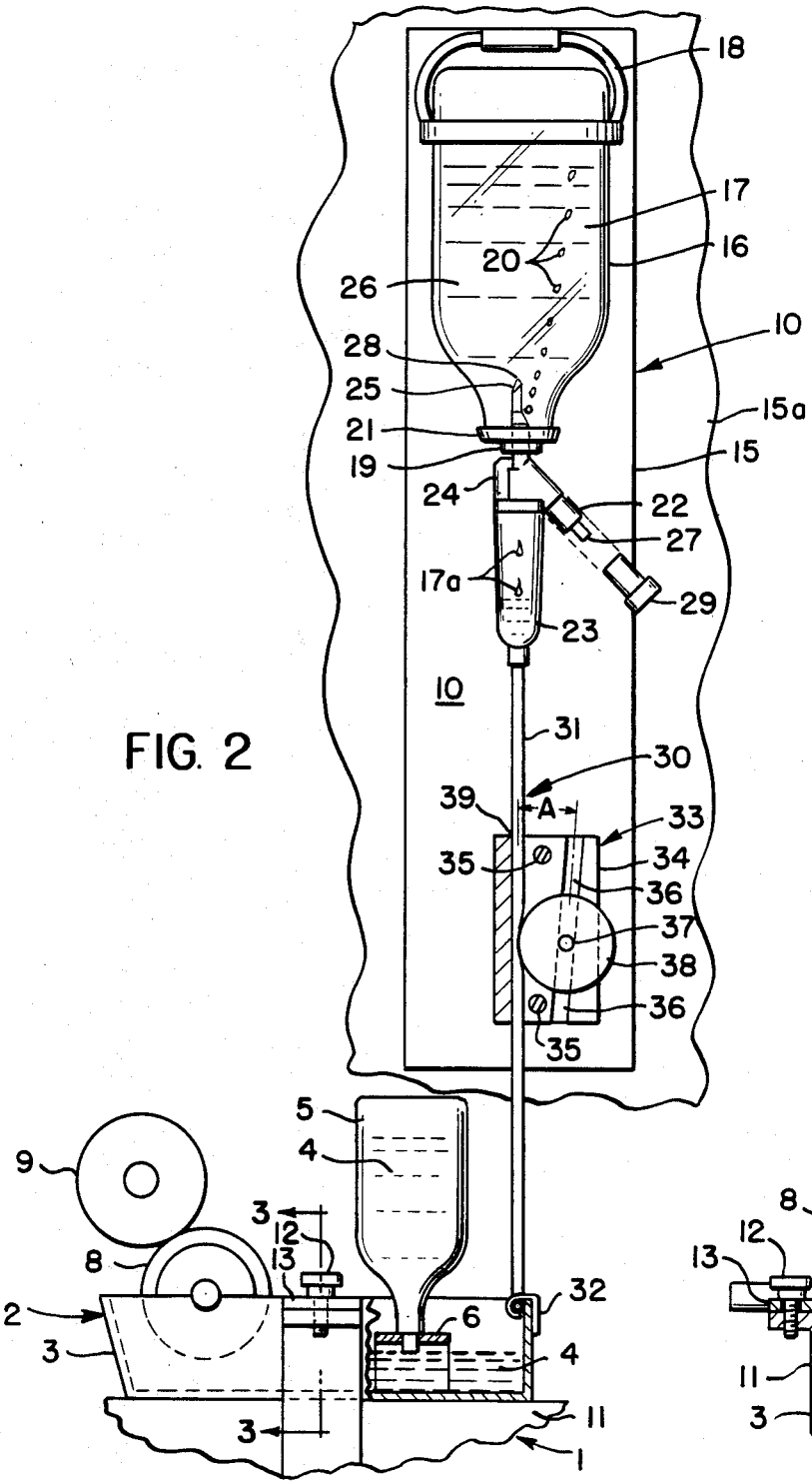
FIG. 2 is a sectional side view of the supplementary liquid dispensing device of FIG. 1.
Figure 3:
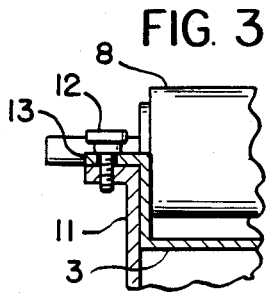
FIG. 3 is a fragmentary cross-sectional view of a fountain solution tray taken along line 3—3 of FIG. 2.
Figure 5:
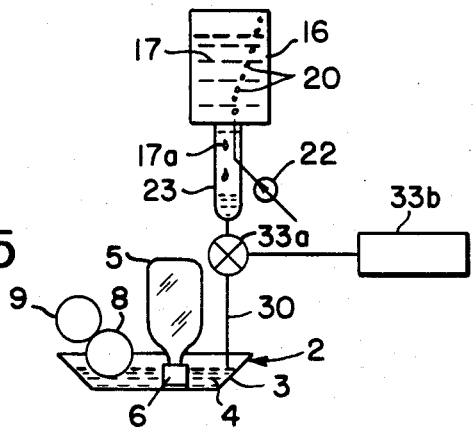
FIG. 5 is a diagramatic view of the supplementary liquid dispensing device shown in FIG. 1 in which the device has a one-way valve for admitting air at atmospheric pressure into a closed bottle containing supplementary liquid and a control valve for gravity feeding of the supplementary liquid to a fountain solution of a lithographic offset printing press in accordance with the invention.

Referring now to FIGS. 1–3 inclusive and FIG. 5 of the drawing, the supplementary liquid dispensing device 10 in accordance with a preferred embodiment of the invention is shown as being utilized with a lithographic offset printing press 1 manufactured by A. B. Dick Co. and more particularly with the dampening system 2 of the press 1.

Reference may be made to a publication entitled *Photo-Lithography by* Z. A. Purst, published by the Goodheart-Willcox Company, Inc. for a description of the A. B. Dick Co. press 1 and a dampening system 2 therein. Reference is also made to publications *Lithographer* 1 & *C* (NAVEDTRA 10454-C) and *Lithographer* 3 & 2 (NAVEDTRA 10452-C), both of which are published by Naval Education and Training Program Development Center, United States Government Printing Office, Washington, D. C. 1980.

Only that part of the lithographic offset printing press 1 and its dampening system 2 are shown to give an understanding of the invention while other details and parts of the press 1 and dampening system 2 are omitted since reference may be made to the above publication for more details of the press 1 and the dampening system 2. The dampening system 2 includes a fountain pan or tray 3 for containing a fountain solution 4 therein, an inverted reservoir bottle 5 supported on a tray bracket 6 for maintaining a predetermined level of fountain solution 4 in the tray 3, a fountain roller 8 and a ductor roller 9. Other rollers (not shown) are part of the dampening system 2 which coact with the ductor roller 9 and fountain roller 8 to carry the fountain solution 4 to a printing plate (not shown) to keep the nominage areas (not shown) from accepting ink. The tray 3 is secured to the press frame 11 of the press 1 by a thumb screw 12 and two side brackets, one of which is shown at 13.

The fountain solution 4 is also called etch. The fountain solution 4 may be a solution of water, alcohol, gum arabic acid and other chemicals useful in dampening the printing plates (not shown) and keeping the nonimaging area from accepting ink. The reservoir bottle 5 contains a supply of fountain solution 4. Since the fountain solution 4 is in an open fountain pan or tray 3 and the fountain solution 4 is spread over the fountain roller 8 and ductor roller 9 and other rollers (not shown), the alcohol 17 in the fountain solution 4 may evaporate into the ambient air. When the alcohol 17 evaporates, the specific gravity and pH of of the fountain solution 4 varies from the desired specific gravity and pH and therefore the quality of printing decreases, thus creating waste, low efficiency and increases the cost of printing proportionately.

In accordance with the invention, the supplementary liquid dispensing device 10 replenishes the fountain solution 4 with alcohol 17 at approximately the same rate at which the alcohol 17 in the fountain solution 4 is lost. The supplementary liquid dispensing device 10 includes a dispensing frame 15 and 15*a*, an inverted liquid dispensing bottle 16 containing alcohol 17 and a bottle support means 18 for supporting the bottle 16 on the dispensing frame 15 and 15*a*. A rubber stopper 19 is disposed at the bottle opening 21 to totally enclose and contain the alcohol 17 within the liquid dispensing bottle 16, thereby preventing alcohol 17 from evporating from the bottle 16. The supplementary liquid dispensing device 10 also includes a one-way valve 22 for the entry of air 20 at atmospheric pressure into the bottle 16 whenever the air pressure within the bottle 16 drops below atmospheric pressure, a viewing tube 23 and a viewing tube frame 24 for supporting the viewing tube 23 and the one-way valve 22. The viewing tube frame 24 has an internal liquid passageway duct 25 communicating with the viewing tube 23 and the alcohol 17 within the bottle interior 26 of the liquid dispensing bottle 16. The viewing tube frame 24 also includes an air passageway duct 27 communicating with the atmospheric air 20 and the bottle interior 26. The viewing tube frame 24 terminates at a frame point 28 for insertion through the rubber stopper 19 into the bottle interior 26 of the bottle 16. The one-way valve 22 may be de-activated by a valve cap 29 which blocks the air passageway duct 27 thereby prohibiting air 20 from entering into the bottle 16.

The supplementary liquid dispensing device also includes piping means 30 for gravity flow of alcohol 17 from the viewing tube 23 into the fountain pan or tray 3 of the dampening system 2. The piping means 30 includes flexible rubber hosing or plastic tubing 31 and a tube clamp 32 for clamping the tubing 31 to the fountain pan or tray 3. Flexible plastic tubing 31 is more desirable than semi or rigid tubing 31 since such tubing 31 is adaptable to coact with an inexpensive control valve means 33 for controlling the flow of alcohol 17 in the tube 31. The control valve means 33 includes a valve body 34 shown in cross-section. The valve body 34 is attached to the frame 15 by a pair of screws 35 amd includes a pair of channels or grooves 36 in which an axle 37 of a knurl wheel 38 rides. The valve body 34 includes a bearing surface 39 contiguous to the plastic tubing 31. The knurl wheel 38 and its axle 37 ride along the grooves 36. The grooves 36 are disposed at a angle A with respect to the bearing surface 39. The angle A is 7 degrees or less so as to be a locking angle A, that is, when the knurl wheel 38 is moved downward and guided by the grooves 36, the knurl wheel 38 pinches the plastic tubing 31 to control the flow of alcohol within the plastic tubing 31 and at the same time the knurl wheel 38 is locked at the selected position. While the above control valve means 33 is shown it should be understood that other mechanical or electro-mechanical control valves means 33*a*. (FIG. 5) may be used for controlling the flow of alcohol 17 into the fountain pan or tray 3. The electro-mechanical control means 33*a* is controlled by an electrical solenoid 33*b* which turns the electro-mechanical control valve means 33*a* in either the "on" or "off" state in response to the printing press 1 being energized or de-energized respectively. If desired, the piping means 30 may of course be rigid piping with appropriate coacting control valve means 33 without departing from the invention.

In the operation of the supplementary liquid dispensing device 10 shown in FIGS. 1, 2, 3 and 5, alcohol 17 is supplied to the fountain solution 4 in the fountain pan or tray 3 at a rate substantially equal to the rate of loss of alcohol in the dampening system 2. The frame cap 29 is removed from the viewing tube frame 24. Alcohol 17 is now permitted to flow into the viewing tube 23 through the internal liquid passageway duct 25 of the viewing tube frame 24 until a slight vacuum is created within the bottle 16 at which time the flow momentarily stops until the one-way valve 22 permits the entry of air 20 at atmospheric pressure into the bottle 16, thereby permitting the flow of alcohol 17 into the viewing tube 23 to resume. The entry of air 20 into the bottle 16 is shown by a series of air bubbles 20 migrating within the interior 26 of the bottle 16. The one-way valve 22 operates on differential pressure as is well known to those skilled in the art, that is air 20 at atmospheric pressure is admitted into the bottle 16 when a vaccuum or the air pressure within the bottle 16 is less than atmospheric pressure. The control valve means 33 controls the rate of flow of alcohol 17 from the liquid dispensing bottle 16 into the fountain solution in the fountain pan or tray 3. The rate of flow of alcohol 17 may be measured in the viewing tube 23 by the number of drops 17*a* falling from the viewing tube frame 24 into the viewing tube 23 per unit of time. The desired amount of alcohol 17 in the fountain solution 4 may now be kept at a constant level by regulating the control valve means 33 to permit a flow of alcohol 17 from the liquid dispensing bottle 16 into the fountain solution 4 at a rate equal to the loss of alcohol 17 in the fountain solution 4. As aforesaid, the loss of alcohol 17 in the frountain solution 4 is primarily due to evaporization of the alcohol 17 from the fountain solution 4. It should be noted that the supplementary liquid dispensing device 10 in and of itself does not contribute to the loss of alcohol 17 through evaporization.

Figure 4:
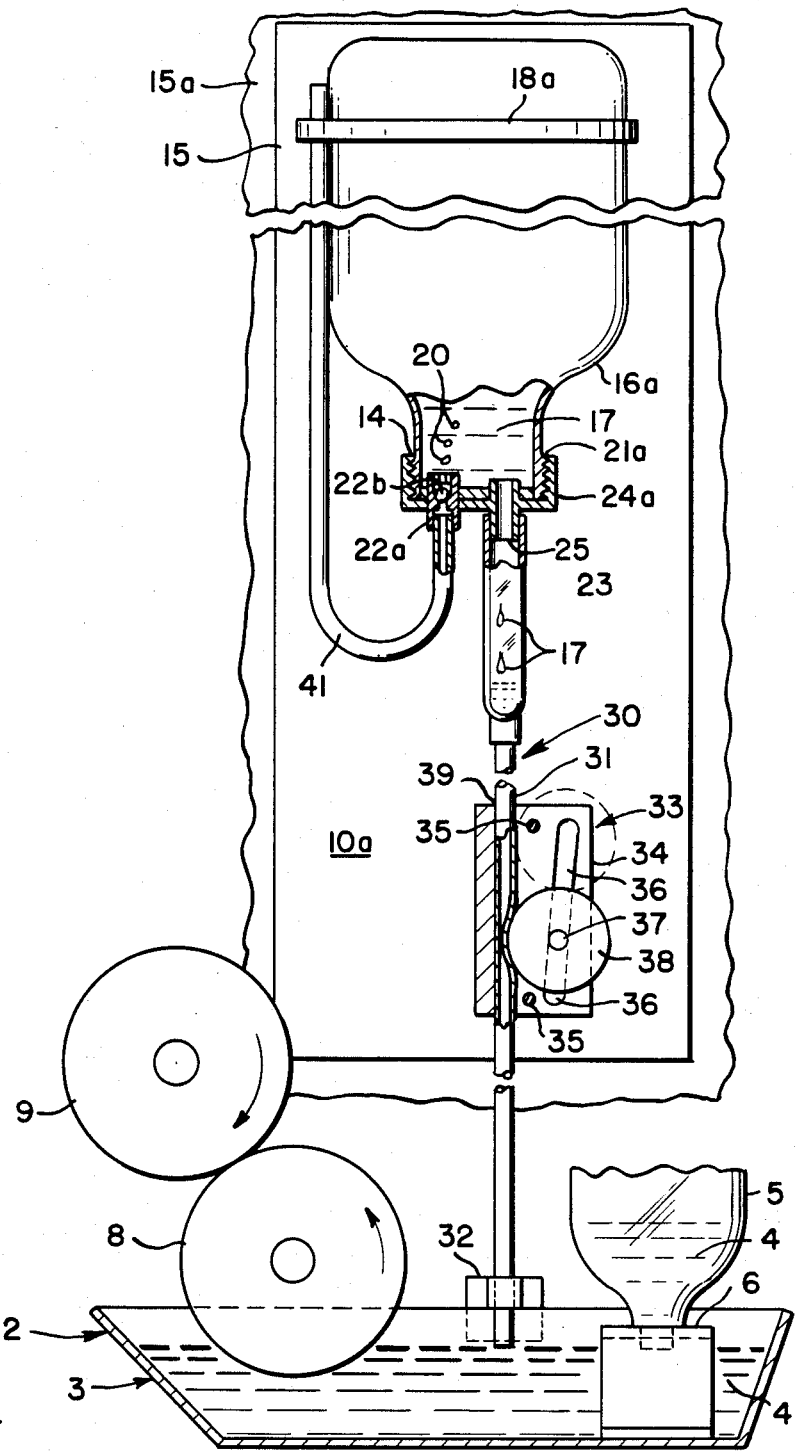
FIG. 4 is a side sectional view of another embodiment of the supplementary liquid dispensing device in accordance with the invention.

Referring now to FIGS. 4 and 5, another embodiment of the supplementary liquid dispensing device 10*a* is shown. The supplementary liquid dispensing device 10*a* is similar to the supplementary liquid dispensing device of FIGS. 1 and 2. Those features and structural elements which are the same will have the same numerical designations. Those features and structural elements of the supplementary liquid dispensing device 10*a* of FIG. 4 which features and elements differ from the supplementary liquid dispensing device 10 of FIGS. 1 and 2 shall have the letter "a" added after the numerical designation to show that structural element belongs to the supplementary liquid dispensing device 10*a* of FIG. 4. The supplementary liquid dispensing device 10*a* of FIG. 4 differs from the supplementary liquid dispensing device 10 of FIG. 2 in that liquid dispensing bottle 16*a* has a threaded bottle opening 21*a* and is adapted to receive a modified viewing tube frame 24*a* having a threaded portion 14 adapted to thread onto the threaded bottle opening 21*a* in sealing relationship therewith. The supplementary liquid dispensing device 10*a* includes a one-way valve 22*a* which operates and functions the same as the one-way valve 22 of the device 10. The one-way valve 22 and 22*a* are well known to those skilled in the art and both operate in the same manner; that is if the pressure inside the bottle 16*a* acting on the ball 22*b* of the one-way valve 22 is greater than atmospheric pressure, air 20 will not enter the bottle 16*a*; however, if atmospheric pressure acting on the ball 22*b* of the one-way valve 22 is greater than the internal pressure within the bottle 16*a*, then air 20 will enter the bottle 16*a* as shown by the air bubbles 20. When the pressure within the bottle 16*a* is at atmospheric pressure, the weight of the alcohol 17 permits the gravity flow of the liquid through the internal liquid passageway duct 25*a* of the modified viewing tube frame 24 as may be noted by the drops of alcohol 17 in the viewing tube 23. The one-way valve 22*a* is connected to a flexible rubber hose or plastic tubing 41 which is bent in a "U" shape to facilitate the tipping of the bottle 16*a* to the inverted position as shown in FIG. 4 after the bottle 16*a* is filled with alcohol 17 in the upright position. The operation of the supplementary liquid dispensing device 10*a* of FIG. 4 is the same as that of the supplementary liquid dispensing device 10 of FIG. 2. The bottle 16*a* may be filled with alcohol 17 in the upright position and placed proximal to the modified viewing tube frame 24*a* and screwed into the viewing tube frame 24*a* while the viewing tube 23 and the flexible plastic tubing 41 is still connected to the one-way valve 22*a*. This is possible since the flexible plastic tubing 31 is of sufficient length to flex for the purpose of assembling the bottle 16*a* to the viewing tube frame 24*a*. The plastic tubing 31 permits the bottle 16 to be much higher than the controlled valve means 33 so that the weight of the alcohol 17 in the bottle 16*a* will gravity feed through the control valve means 33 into the fountain pan or tray 3. Once the bottle 16 has been assembled to the viewing tube frame 24, it is tipped to the inverted position and fixed to the frame 15 by the bottle support means 18*a*. The flow of alcohol 17 from the bottle 16*a* to the fountain solution 4 in the fountain pan or tray 3 by operating the knurl wheel 38 of the control valve means 33. The wheel 38 depending on its position with respect to the flexible tubing 31 pinches the tubing 31 to permit the flow of alcohol 17 into the fountain solution 4 in the same manner as just described for the supplementary liquid dispensing device 10 of FIG. 2.

The present invention is also particularly suited for a multicolor press (not shown) which simply includes a series of single printing units (not shown) integrated into one printing press. Each unit has its own inking and dampening system for printing in a given color ink. Since some color inks dry at different times, the amount of alcohol 17 in the fountain solution 4 plays an important part for such drying of the ink. In accordance with the present invention, a supplementary liquid dispensing device may be combined with each dampening system 2 so that each dampening system 2 may have a fountain solution 4 with the desired alcohol in the fountain solution 4.

Figure 6:
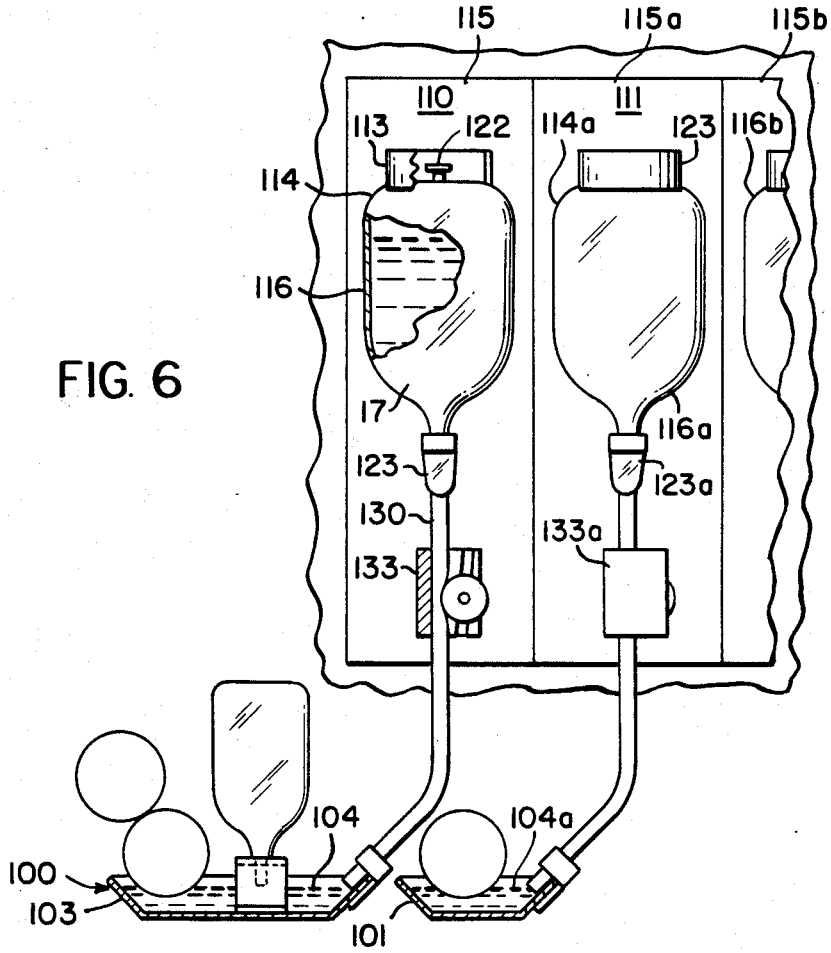
FIG. 6 is another embodiment of the invention showing the use of a plurality of supplementary liquid dispensing devices for a lithographic offset printing press having one or more dampening systems therein.

Referring now to FIG. 6, two dampening systems 100, 101 for a multicolor printing press (not shown) are each combined with one of two corresponding supplementary liquid dispensing devices 110, 111 respectively. The supplementary liquid dispensing devices 110, 111 are similar to each other and will be described concurrently with the small letter "a" being added to the corresponding parts for the supplementary liquid dispensing device 111. Each of the dampening systems 100, 101 are similar to each other and also similar to the dampening system 2 of FIG. 2, except that the fountain solution 104, 104*a* for the dampening systems 100, 101 respectively differ as to the alcohol 17 contents therein. The reason for this is that each colored ink dries at a different rate and the amount of alcohol 17 in the fountain solution 104, 104*a* is directly proportional to the drying time required for the colored ink.

The supplementary liquid dispensing devices 110, 111 differ from the supplementary liquid dispensing device 2 in that the one-way valve 22 (FIG. 2) has been changed to a shutoff valve 122 and placed at the bottom of the bottles 116 to allow atmospheric pressure to act on the alcohol 17 in the bottle 116. The shutoff valve 122 of course should be closed when the bottle is being filled. A ring guard 113 is fixed to the bottle 116 to protect the shut-off valve 122. Each of the supplementary liquid dispensing devices 110, 111 includes a viewing tube 123, 123*a* and control valve means 133, 133*a* for controlling the flow of alcohol 17 in the fountain solution 104, 104*a*. The supplementary liquid dispensing devices 110, 111 may be mounted on individual dispensing frames 115, 115*a* respectively. It should also be understood that additional supplementary liquid dispensing devices 115 may be utilized as shown in FIG. 4 by the addition of a third dispensing frame 115*b* and liquid dispensing bottle 116*b*. Accordingly, a multicolor press, not shown, may have as many supplementary liquid dispensing devices 115 which correspond to the number of dampening systems 100 within the multicolor press.

In the operation of the supplementary liquid dispensing device 110, the liquid dispensing bottle 116 is filled with alcohol 17 so that piping means 130 may carry the alcohol 17 to the fountain solution 104 in a fountain pan or tray 103. When the shutoff valve 122 is on the open state, atmospheric pressure is placed on the alcohol 17 within the liquid dispensing bottle 116. The rate of flow from the liquid dispensing bottle 116 to the fountain solution 104 is regulated by the control valve means 133 and may be observed in the viewing tube 123. The rate of flow, of course, may be regulated to equal the rate of loss or evaporation of alcohol 17 from the fountain solution 104. The supplementary liquid dispensing device 110 may be closed down or turned off by simply closing the control valve means 133 and shutoff valve 122.

Having thus described the invention, it will be evident that other modifications and improvements may be made by one skilled in the art which would come within the scope of the annexed claims.

What is claimed as new and desired to be secured by Letters Patent of the United States is:

1. A supplementary liquid dispensing device for continuously replacing alcohol lost from a fountain solution of a dampening system in a lithographic printing press, said dampening system having a fountain solution tray for containing said fountain solution therein, reservoir means for supplying said fountain solution to said tray at a given level therein, a rotatable fountain roller communicating with said fountain solution in said tray for wetting said fountain roller with said fountain solution, said supplementary liquid dispensing device comprising:
   (a) a frame,
   (b) bottle means for containing said alcohol therein,
      (i) said bottle means includes a bottle mounted on said frame,
   (c) piping means connected to said bottle means for gravity flowing of said alcohol directly into said fountain solution in said fountain tray and disposed in co-operative relationship with said rotatable fountain roller for mixing said alcohol with said fountain solution, and
   (d) valving means connected to said piping means for controlling said flow of said alcohol directly into said tray and said fountain solution at a rate substantially equal to the rate of loss of said alcohol from said fountain solution.

2. The invention defined in claim 1 wherein said valving means includes an electro-mechanical means for terminmating said flow of said alcohol in said piping means whenever said lithographic printing press is in a de-energized state.

3. The invention defined in claim 1 wherein said alcohol is anhydrous isopropyl alcohol.

4. The invention defined in claim 1 wherein said frame is fixed to said lithographic printing press and said bottle means for containing said alcohol includes an inverted bottle detachably mounted on said frame.

5. The invention defined in claim 1 wherein said piping means includes plastic tubing having a resilient collapsible wall responsive to said valving means for regulating the flow of said alcohol through said plastic tubing.

6. The invention defined in claim 1 further including a one-way valving means for ingress of ambient air into said bottle when the ambient air pressure outside said bottle is greater than the weight of said alcohol together with the internal pressure within said bottle acting on said one-way valving means.

7. The invention defined in claim 1 further including a one-way valving means for ingress of ambient air into said bottle, said one-way valving means includes a ball responsive to a differential pressure between said ambient air pressure and the combined weight of said alcohol acting on said ball with the internal pressure within said bottle means for the ingress of ambient air only when said differential pressure is positive.

8. The invention defined in claim 1 further including a monitoring means having a viewing tube connected to said piping means for observing said rate of flow of said alcohol in said piping means.

9. A supplementary liquid dispensing device for continuously replacing alcohol lost from a fountain solution of a dampening system in a lithographic printing press, said dampening system having a fountain solution tray for containing said fountain solution therein, reservoir means for supplying said fountain solution to said tray at a given level therein, a rotatable fountain roller communicating with said fountain solution in said tray for wetting said fountain roller with said fountain solution, said supplementary liquid dispensing device comprising:
   (a) a frame,
   (b) bottle means for containing said alcohol therein,
      (i) said bottle means includes a bottle mounted on said frame,
   (c) piping means connected to said bottle means for gravity flowing of said alcohol directly into said fountain solution and said fountain tray and disposed in cooperative relationship with said rotatable fountain roller for mixing said alcohol with said fountain solution,
   (d) valving means for controlling said flow of said alcohol to said tray at a rate substantially equal to the rate of loss of said alcohol from said fountain solution in said tray,
      (i) said valving means includes electromechanical means for terminating said flow of said alcohol in said piping means whenever said lithographic printing press is in a de-energized state, and
   (e) monitoring means including a viewing tube connected to said piping means for observing said flow of said alcohol in said piping means.

* * * * *